US005433633A

United States Patent [19]

Matsumoto et al.

[11] Patent Number: 5,433,633

[45] Date of Patent: Jul. 18, 1995

[54] ELECTROMAGNETICALLY SHIELDED CONNECTOR

[75] Inventors: Mitsuhiro Matsumoto; Satoshi Yamada, both of Shizuoka, Japan

[73] Assignee: Yazaki Corporation, Tokyo, Japan

[21] Appl. No.: 208,238

[22] Filed: Mar. 10, 1994

[30] Foreign Application Priority Data

Mar. 12, 1993 [JP] Japan ..... 5-051864

[51] Int. Cl.[6] ..... H01R 13/648

[52] U.S. Cl. ..... 439/607; 439/95

[58] Field of Search ..... 439/92, 95, 96, 100, 439/101, 108, 607, 609, 610

[56] References Cited

U.S. PATENT DOCUMENTS

| | | | |
|---|---|---|---|
| 3,808,353 | 4/1974 | Burtelson | 439/96 X |
| 5,045,977 | 9/1991 | Cesar | 439/607 X |
| 5,083,945 | 1/1992 | Miskin et al. | 439/607 |
| 5,102,354 | 4/1992 | Crane et al. | 439/607 X |

FOREIGN PATENT DOCUMENTS

| | | |
|---|---|---|
| 63-127083 | 8/1988 | Japan . |
| 5-25679 | 4/1993 | Japan . |

*Primary Examiner*—Khiem Nguyen

*Attorney, Agent, or Firm*—Armstrong, Westerman, Hattori, McLeland & Naughton

[57] ABSTRACT

An electromagnetically shielded connector where a shielding metal shell is molded together with an insulating housing in which terminals are housed. The metal shell is formed with a resilient contact integrally continuous therewith. The insulating housing is formed with two opposing guide grooves on an exterior thereof between which the resilient contact projects outwardly of the insulating housing. The opposing guide grooves receive a fastening bracket electrically connected to ground, thereby the insulating housing being fixed and the shielding metal shell being connected to ground via said resilient contact and said fastening bracket.

2 Claims, 5 Drawing Sheets

ELECTROMAGNETICALLY SHIELDED CONNECTOR

BACKGROUND OF THE INVENTION

Field of the Invention

The present invention relates to an electromagnetically shielded connector which is used for electrical routing in an automobile, and in which electromagnetic noise is directly passed to the body of the vehicle.

Prior Art

FIG. 7 is a longitudinal cross-sectional view of a prior art electromagnetically shielded connector K disclosed in Japanese Utility Model Preliminary Publication No. 63-127083 where terminals are shielded from electromagnetic noise. A cylindrical metal shell d is provided between an insulating cover a made of synthetic resin and a housing c that houses terminals b. The metal shell d is connected to the shielding wire e so that noise developed between the connector K and the mating connector is passed to the ground via the shielding wire e. This prior art connector requires an extra assembly operation to connect the shielding wire e to an external ground terminal so that the metal shell d is properly grounded. This makes assembly operation more complex and may cause poor electrical contact which in turn leads to poor shielding effect.

Japanese Utility Model Application No. 3-73979 discloses a shielded connected K' as shown in FIG. 8, proposed by the Applicant of the instant application. A metal shell d' is provided between an inner housing f and an outer housing g. A metal clamp h is provided which projects outwardly of the outer housing g. The metal clamp h is secured to the body of the vehicle by means of a bolt i. Thus, an extra cumbersome assembly step is required to screw the bolt i.

The present invention was made in view of the aforementioned drawbacks of the prior art electromagnetically shielded connectors.

SUMMARY OF THE INVENTION

An object of the invention is to provide an electromagnetically shielded connector that provides good shielding effect and is simple in connecting to the ground.

A shielding metal shell is molded together with an insulating housing that houses terminals. The shielding metal shell is formed with a resilient contact integrally continuous therewith. The insulting housing is formed with two opposing guide grooves, on an exterior thereof, between which the resilient contact projects outwardly of the insulating housing. The insulating housing is firmly fixed when a fastening bracket is inserted into the grooves. The fastening bracket is in contacting engagement with the resilient contact due to the resiliency of the resilient contact when the fastening bracket is fully inserted into the grooves, thereby the shielding metal shell being connected to ground via said resilient contact and said fastening bracket.

BRIEF DESCRIPTION OF THE DRAWINGS

Features and other objects of the invention will become more apparent from the description of the preferred embodiments with reference to the accompanying drawings in which.

DESCRIPTION OF PREFERRED EMBODIMENTS

Construction

Figure 1:
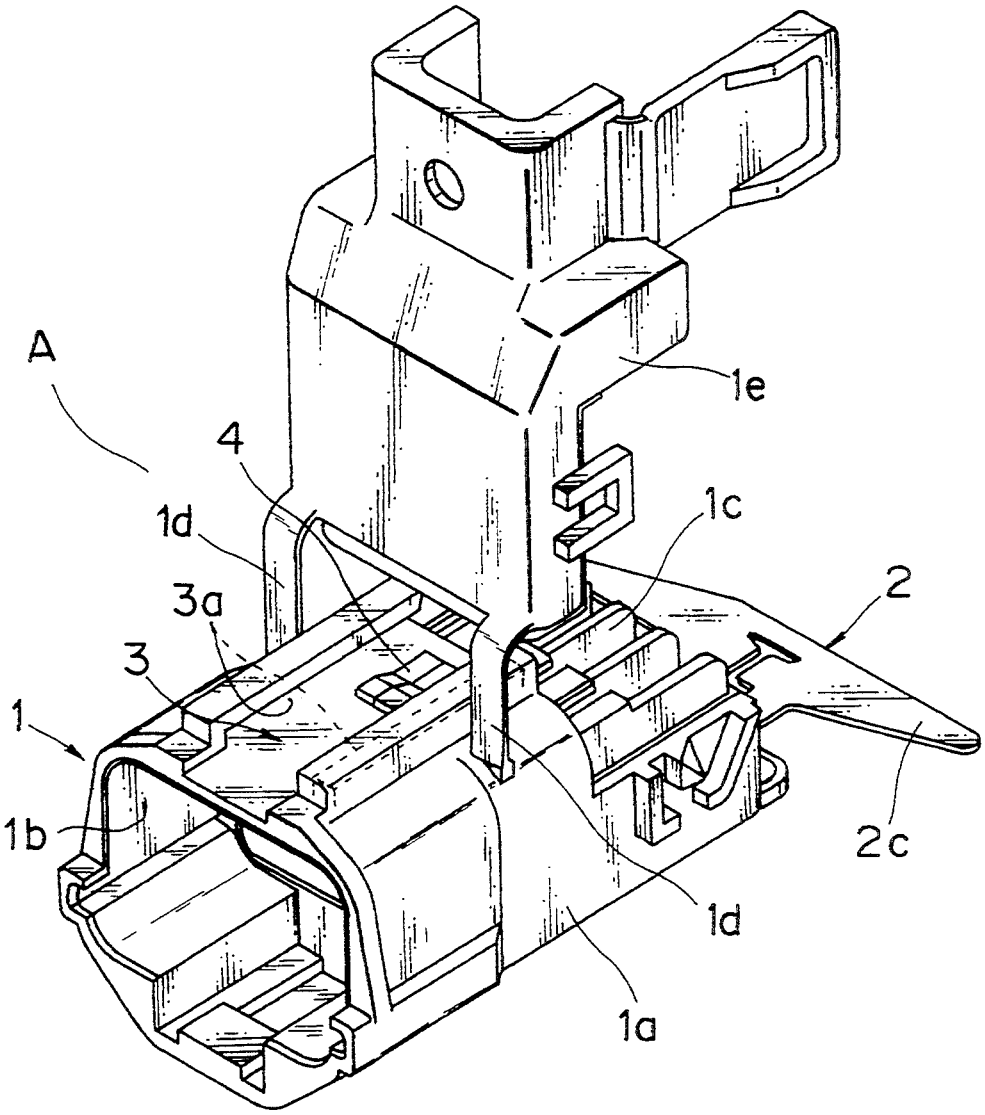
FIG. 1 is a perspective view of one half A of the electromagnetically shielded connector according to the invention, which is to be inserted into another half B.
Figure 2:
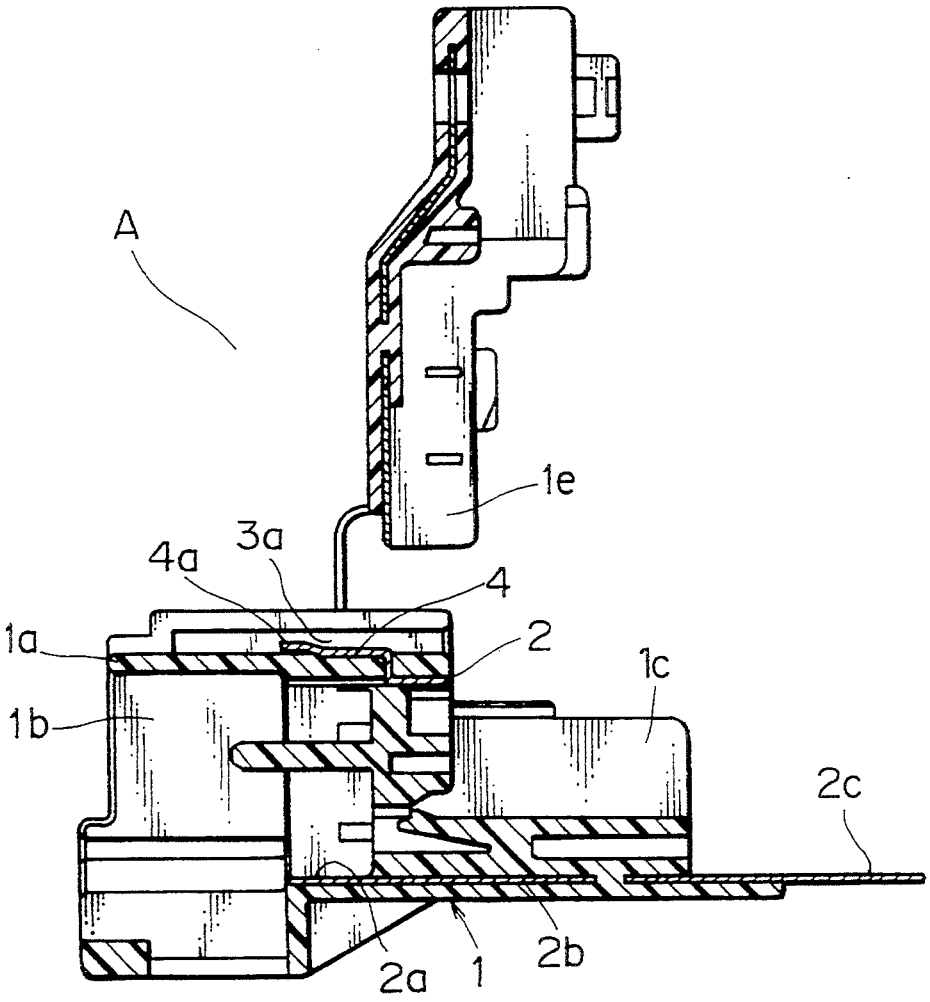
FIG. 2 is a longitudinal cross-sectional view of the connector in FIG. 1.

An electromagnetically shielded connector according to the invention includes two halves. Inserting one half into the other completes electrical connection of the shielded connector. FIG. 1 is a perspective view of one half A of the electromagnetically shielded connector. FIG. 2 is a longitudinal cross-sectional view of FIG. 1. The connector A is of one-piece construction where an outer shell 1*a* of a housing 1 is insert-molded from synthetic resin together with electromagnetically shielding metal shell 2.

The housing 1 h has at a front half thereof a fitting portion 1*b* into which a mating connector is to fit, and at a rear half thereof terminal cavities by which terminals crimped to shielding wires are received. The housing 1 has a wire retainer 1*e* which is integrally continuous with the housing 1 via flexible hinges 1*d*. Between the hinges 1*d* is formed a fastening-bracket retainer 3 having opposed guide grooves 3*a*.

Figure 3:
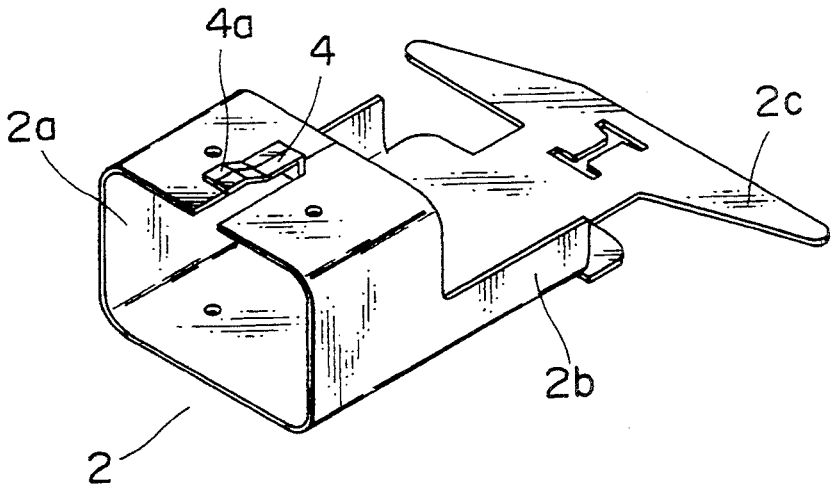
FIG. 3 is a perspective view of the metal shell in FIG. 2.

As shown in FIG. 3, the metal shell 2 is formed by pressing an electrically conductive metal plate. The metal plate is folded to close at a front thereof to form a fitting portion 2*a*. The metal shell 2 is formed with a holding portion 2*b* at an middle portion thereto, and a wing-like crimp portion 2*c* which is to be crimped to the shielding wire to firmly hold the shielding wire.

The fitting portion 2*a* of the metal shell 2 is formed with a resilient contact 4 that rises outwardly of the fitting portion 2*a* and projects into the retainer 3 when molded together with the housing 1. The holding portion 2*b* is molded integrally continuous with the outer shell is of the housing 1. The resilient contact 4 is kinked at a distal end thereof to form a fastening projection 4*a*.

Figure 4:
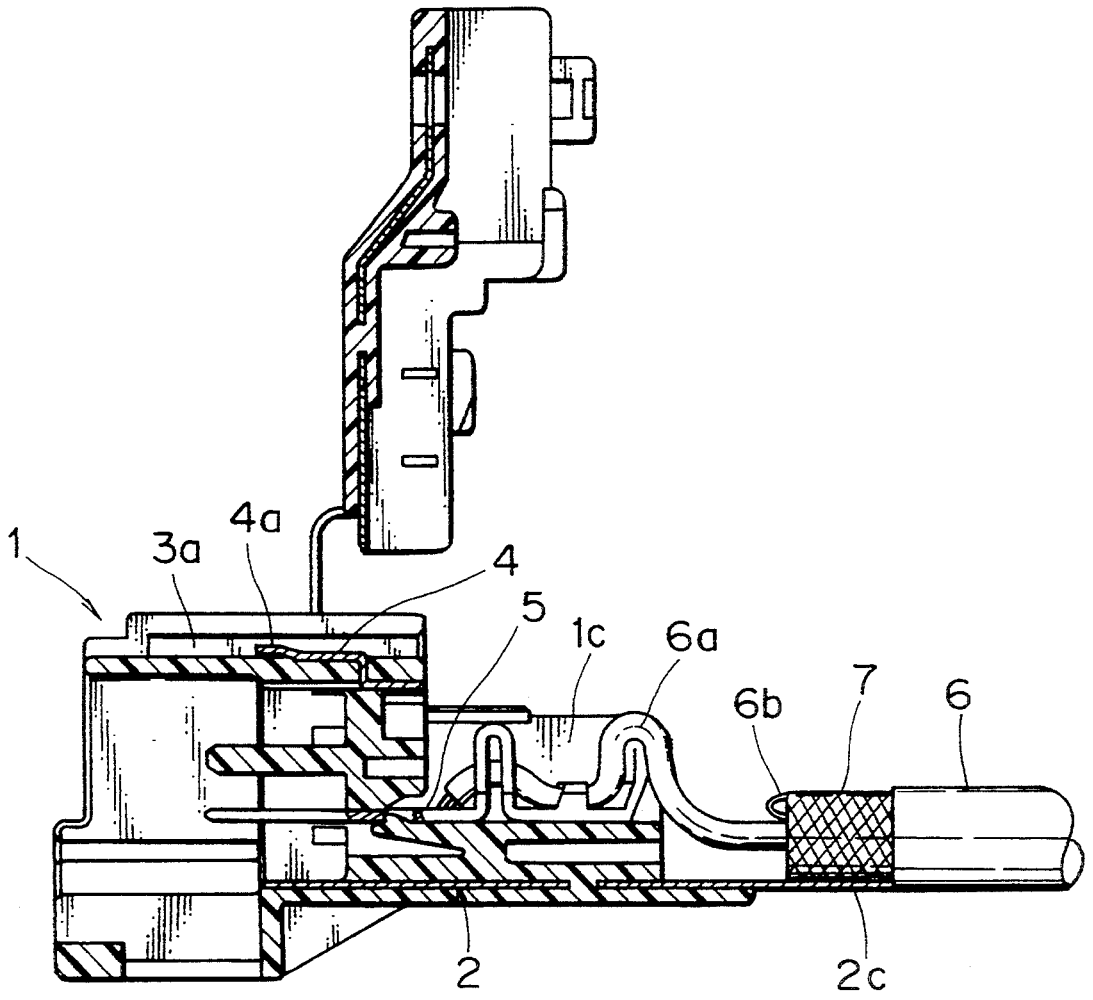
FIG. 4 is a longitudinal cross-sectional view of a connector where a shielding wire connected to the terminal is assembled into the housing in FIG. 2.

FIG. 4 is a longitudinal cross-section view, showing a terminal 5 inserted into the terminal cavity of the housing 1. The terminal 5 is crimped to a wire 6*a*. The shielding wire 6 is stripped to expose a drain 6*b* used for grounding the end portion of the shielding wire 6 around which a conductive tape 7 closely wraps. A wing-like crimp portion 2*c* is then folded inwardly to crimp to the shielding wire 6 at the conductive tape 7.

Figure 5:
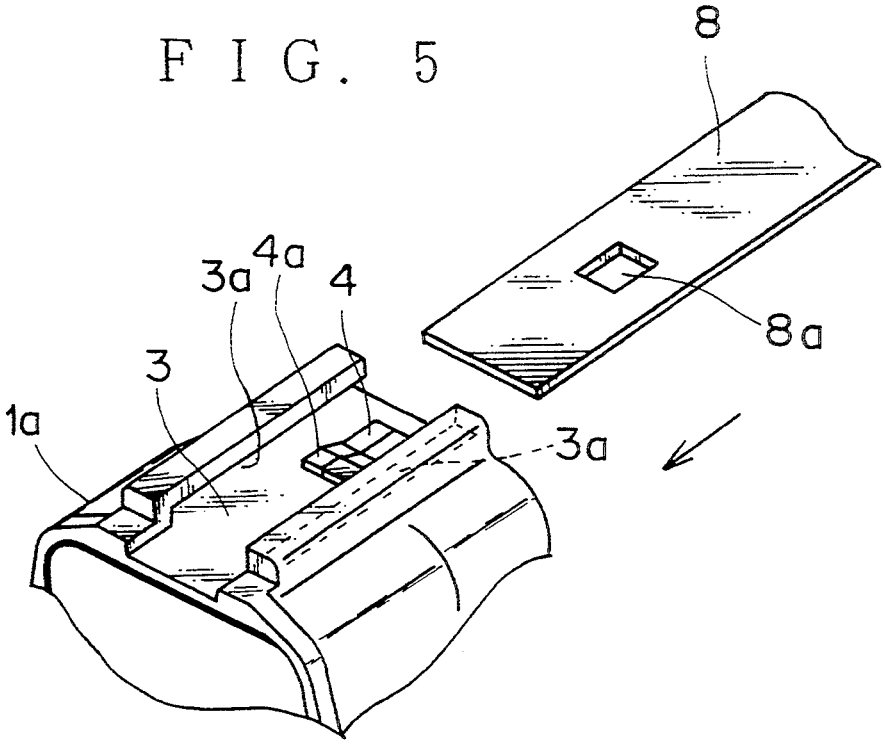
FIG. 5 illustrates an assembly step where the fastening bracket is about to be inserted into the two opposed guide grooves.
Figure 7:
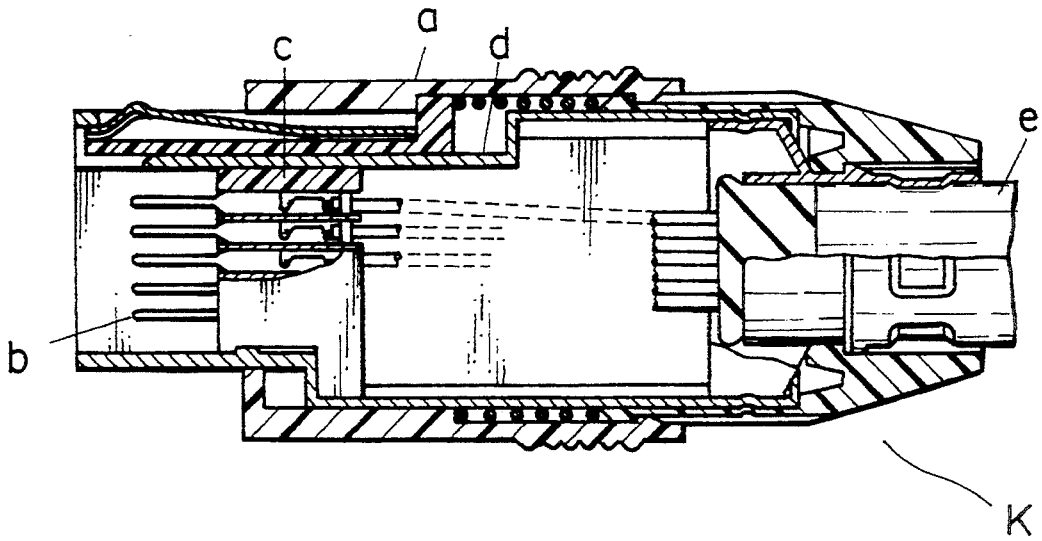
FIG. 7 PRIOR ART
FIG. 7 is a longitudinal cross-sectional view of a prior art electromagnetically shielded connector.
Figure 6:
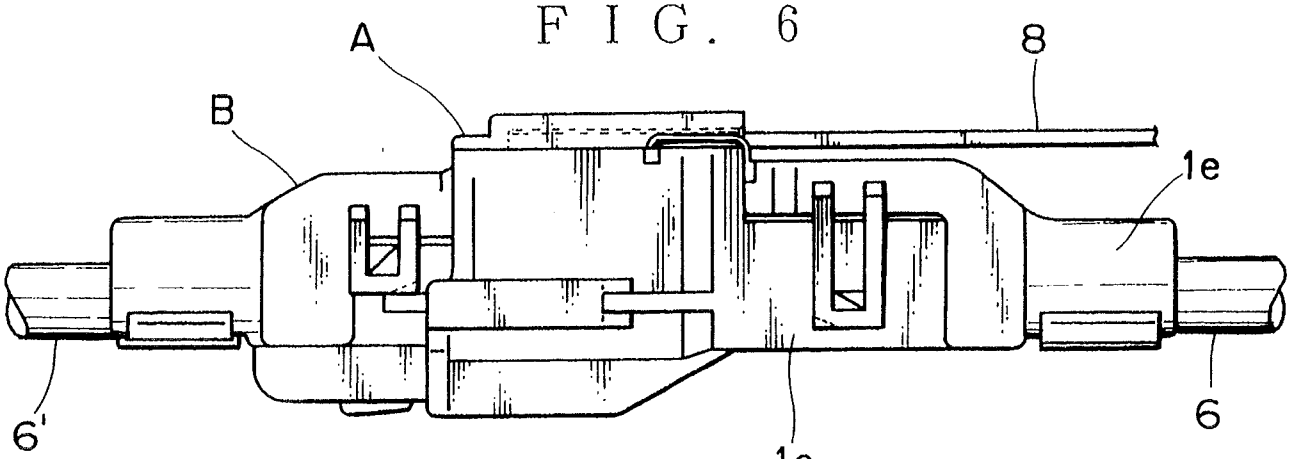
FIG. 6 is a side view, showing the electromagnetically shielding connector A in FIG. 4 that has been fully fitted into the mating electromagnetically shielded connector B with the fastening bracket inserted fully into the guide grooves.
Figure 8:
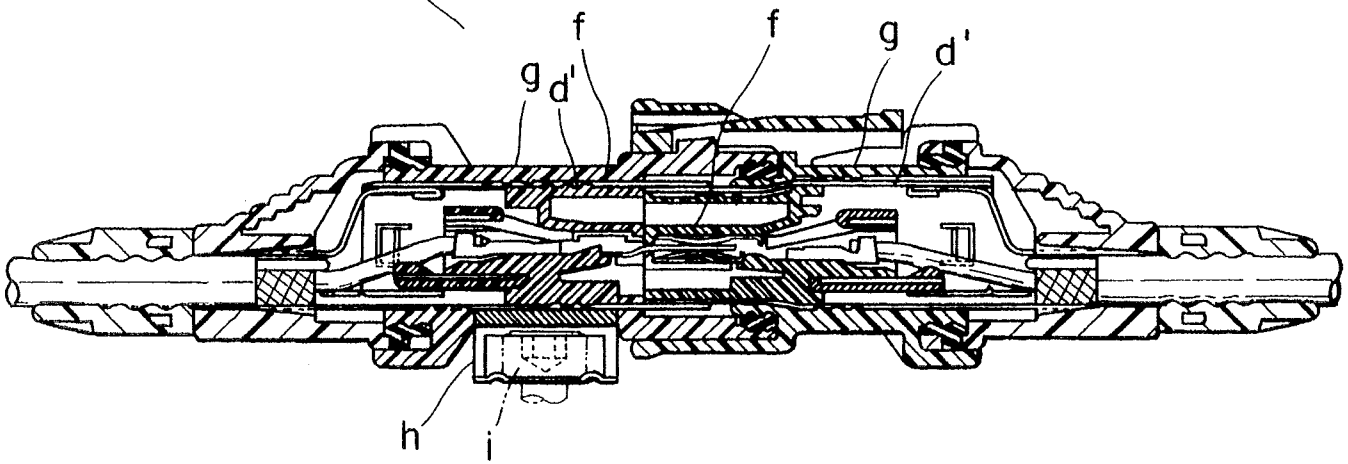
FIG. 8 PRIOR ART
FIG. 8 is a longitudinal cross-sectional view of another prior art electromagnetically shielded connector.

As shown in FIG. 5, the fastening bracket 8, grounded to the body of the vehicle, is inserted into the guide grooves 3*a*, so that the locking hole 8*a* of the fastening bracket 8 engages the resilient contact 4 to electrically connect the metal shell 2 to the vehicle body via the bracket 8.

The above-described electromagnetically shielded connector A is fitted into the mating electromagnetically shielded connector B to which shielded wire 6′ is connected, thereby completing electrical connection between the two halves A and B of the connector.

Operation

The resilient contact 4 is formed integrally continuous with the metal shell 2 that serves to electromagnetically shield the terminals and wires. The resilient contact 4 projects outwardly of the electrically insulating housing 1, so that the resilient contact electrically and mechanically contacts the fastening bracket 8 when the bracket 8 is inserted into the retainer 3. The fastening bracket 8 is electrically connected with the body of the vehicle. This construction eliminates cumbersome screws or bolts that need screwing operation for electrically and mechanically connecting the connector to the vehicle body to ground the connector. The resilient force of the resilient contact 4 ensures good electrical contact between the metal shell and the fastening bracket.

What is claimed is:

1. An electromagnetically shielded connector where a shielding member is molded together with a housing in which terminals are housed, comprising:

an insulating housing; and a resilient contact integrally continuous with a metal shielding shell, said resilient contact projecting outwardly of said insulating housing and engaging a fastening bracket, said fastening bracket being electrically connected to ground, whereby said shielding metal shell is grounded via said resilient contact and said fastening bracket.

2. An electromagnetically shielded connector where a shielding member is molded together with a housing in which terminals are housed, comprising:

an insulating housing formed with two opposing guide grooves on an exterior thereof; and a resilient contact integrally continuous with a metal shielding shell, said resilient contact projecting between said opposing guide grooves and projecting outwardly of said insulating housing, wherein said resilient contact engages a fastening bracket when said fastening bracket is inserted into said guide grooves, said fastening bracket being electrically connected to ground, whereby said shielding metal shell is grounded via said resilient contact and said fastening bracket.

* * * * *